US006568451B1

(12) United States Patent
Korthäuer

(10) Patent No.: US 6,568,451 B1
(45) Date of Patent: May 27, 2003

(54) DEVICE FOR LABELING PACKAGES, IN PARTICULAR FOODSTUFFS PACKAGES

(75) Inventor: Manfred Korthäuer, Mühlheim (DE)

(73) Assignee: Espera Werke GmbH, Duisburg (DE)

( * ) Notice: Subject to any disclaimer, the term of this patent is extended or adjusted under 35 U.S.C. 154(b) by 0 days.

(21) Appl. No.: 09/293,235

(22) Filed: Apr. 16, 1999

(30) Foreign Application Priority Data

Apr. 20, 1998 (DE) ..... 198 17 576

(51) Int. Cl.[7] ..... B65C 9/06; B65C 9/18; B65C 9/30

(52) U.S. Cl. ..... 156/540; 156/541; 156/542; 156/566; 156/DIG. 39; 156/DIG. 27

(58) Field of Search ..... 156/540, 541, 156/542, 387, DIG. 25, DIG. 27, 556, 566, DIG. 28, DIG. 33, DIG. 37, DIG. 39

(56) References Cited

U.S. PATENT DOCUMENTS

| | | | | | |
|---|---|---|---|---|---|
| 3,985,605 | A | * | 10/1976 | Treiber et al. | 156/384 |
| 4,328,063 | A | * | 5/1982 | Ingalls | 156/361 |
| 4,336,095 | A | * | 6/1982 | Hoffman | 156/361 |
| 4,347,094 | A | * | 8/1982 | Watanabe | 156/387 |
| 4,351,679 | A | * | 9/1982 | Dreher | 156/350 |
| 5,425,823 | A | * | 6/1995 | Woodside, III | 156/64 |
| 5,587,043 | A | * | 12/1996 | Hying et al. | 156/566 |
| 5,968,303 | A | * | 10/1999 | Nagasaka | 156/249 |

FOREIGN PATENT DOCUMENTS

| | | |
|---|---|---|
| DE | 32 23 477 A | 12/1983 |
| DE | 40 31 891 A | 4/1991 |
| DE | 196 09 41 A | 9/1997 |
| EP | 0 218 925 A | 4/1987 |
| WO | WO 94 06689 A | 3/1994 |

* cited by examiner

*Primary Examiner*—Mark A. Osele
*Assistant Examiner*—Sue A. Purvis
(74) *Attorney, Agent, or Firm*—Proskauer Rose LLP

(57) ABSTRACT

A device for labeling foodstuffs packages comprises a feed unit for transport of the package in a horizontal direction, a weighing unit arranged in the conveyance path for weighing the package, a printing device for printing a label detchably affixed to a carrier strip, and an application unit for applying the printed label to the underside of the package. The application unit comprises a roller which, during application of the label to the package, is driven so as to be synchronous with the package. The printed label is removed from the carrier strip and carried by a part of the outer circumference of the roller and fed to the underside of the package. The point of labeling the package coincides with the zenith of the roller and the zenith of the outer circumference of the roller arranged on a horizontal projection in the conveyance direction of the package.

12 Claims, 2 Drawing Sheets

DEVICE FOR LABELING PACKAGES, IN PARTICULAR FOODSTUFFS PACKAGES

BACKGROUND OF THE INVENTION

The invention relates to a device for labeling individual packages, in particular foodstuffs packages, comprising

- a feed unit, for transport of the package particularly in horizontal direction
- a weighing unit, arranged in the conveyance path, for weighing the package;
- a printing device for printing a label detachably affixed to a carrier strip; and
- an application unit for applying the printed label to the underside of the package.

Automatic labelling devices are used to apply labels to packages, in particular to foodstuffs packages, onto which among other information the price of the particular foodstuffs package is printed. From practical use, labeling machines are known which apply the label to the foodstuffs package from above in the conventional way. However, from practical use, automatic labeling machines are also known where the label is applied to the underside of the package.

DE 40 31 891 A1 discloses the labeling of the top and the underside of packages conveyed on a feed unit optionally with self-adhesive labels.

Carrying out labeling from below is becoming increasingly important because scanner cash registers read the price from an imprinted barcode. Since in particular in the case of meat packages this barcode should be applied to the underside of the packages, so as to avoid the need for turning the package over at the cash register, the label must be applied to the underside of the package. The provision of further product information such as e.g. use-by date or product number on the underside of the package is also desirable.

Such known automatic labeling devices for applying product labels to the underside of the package provide an aperture in the surface along which the package is conveyed horizontally. The label is fed from below though this aperture. The size of the aperture thus determines the maximum size of the label to be applied. There is a problem with such embodiments of labeling devices in that on the one hand the size of the label to be applied is limited and on the other hand the conveyance means for the package has to have a recess at the position of the aperture. This can lead to an interruption in conveying the package or a lateral displacement. In addition, the underside of the package needs to be flat to prevent it from getting stuck in the aperture or from falling into the aperture.

The state of the art is also set out in DE 32 23 477 A1, from which a machine is known with a transfer roller for applying self-adhesive protective labels to documents, file cards and similar.

SUMMARY OF THE INVENTION

It is thus the object of the present invention to further improve a device of the type mentioned in the introduction so as to reduce the likelihood of mislabeling.

According to the invention this object is met in that the application unit comprises a roller which during the application process of the label is driven so as to be synchronous with the package; with the printed label being removed from the carrier strip and, carried by part of the outer circumference of the roller, being able to be fed to the underside of the package; and with the point of labeling coinciding with the zenith of the roller and with the zenith of the outer circumference of the roller being arranged on a horizontal projection in the direction of conveyance of the package.

The roller is part of the conveyance system for the package, with the roller rotating synchronously with the package during labeling. Consequently, this solution is suitable for applying labels of any size to the underside of the package. In this, the package is not limited in respect to the shape of its underside; even curved or bent undersides can be provided with a label. Furthermore, the position of the label on the underside of the package can be freely selected, because the spatial allocation between the label printer and the position of the package is adjustable along the width of the roller. It is thus the central feature of the solution according to the invention that the label is no longer conveyed completely through an aperture, but is rolled onto the underside of the package from its front to its rear while the package is moving. The printer, in particular the thermal printer, is arranged at the underside of the system resulting in the label, once removed from the carrier roll, being fed from below to the package.

A further advantage is provided in that this arrangement makes it possible to combine the printing according to the invention from below the goods, with a further printer located above for labels on the top of the package. This provides the particular advantage that a first label containing information which is important to the customer, for example the price of the goods, is arranged at the top of the package, and the second label comprising the price in coded machine-readable form is arranged on the underside of the goods so as to be accessible by the bar code reader of the scanner cash register.

Preferably the roller used as an application unit is configured as a drum to which a suitably designed fan applies a partial vacuum. As a result of the partial vacuum, the label is held in place on the surface of the roller during the feed process to the underside of the package while at the same time not adhesively sticking to the roller surface. To this effect, in a further embodiment, the surface of the roller comprises a non-stick silicon coating.

Depending on the size of the labels to be applied, the surface of the drum comprises a greater or lesser number of perforations in an appropriate arrangement.

A further embodiment provides for the surface of the roller to comprise an indentation which interacts with a label catcher. In this way any labels adhering to the surface of the roller, which labels were inadvertently not taken up by a package, are removed by the label catcher which prevents a further rotation of the label.

This label catcher is positioned behind the labeling point, in the direction of conveyance.

If the label does not become completely detached from the carrier paper during printing, a label separation device provided according to a further embodiment, blows an airstream onto the wiping edge of the printer, thus causing the label to be separated from the carrier paper and to be blown in the direction of the labeling roller.

A further preferred embodiment provides for a support roller to be provided between the conveyance device and the labeling roller. The package moves over this roller which prevents rotation or shifting of the package during the transition between the conveyance device and the labeling roller. This roller is preferably made from a material with a soft surface, as is the labelling roller according to a further preferred embodiment.

A further embodiment of the invention provides for a further roller to be arranged behind the labelling roller. Preferably, this further roller is driven at a speed of rotation which results in the circumferential speed of the further roller exceeding the feed speed of the package. It is the purpose of this further roller to brush the label against the underside of the package after the actual labeling process thus counteracting any incomplete adhesion after the labeling process. If for example a corner is not flush, the label may be lost during further conveyance. The further roller is provided to prevent this.

BRIEF DESCRIPTION OF THE DRAWINGS

Below, the invention is illustrated in more detail by a drawing showing one embodiment, as follows.

DETAILED DESCRIPTION OF THE INVENTION

Figure 1:
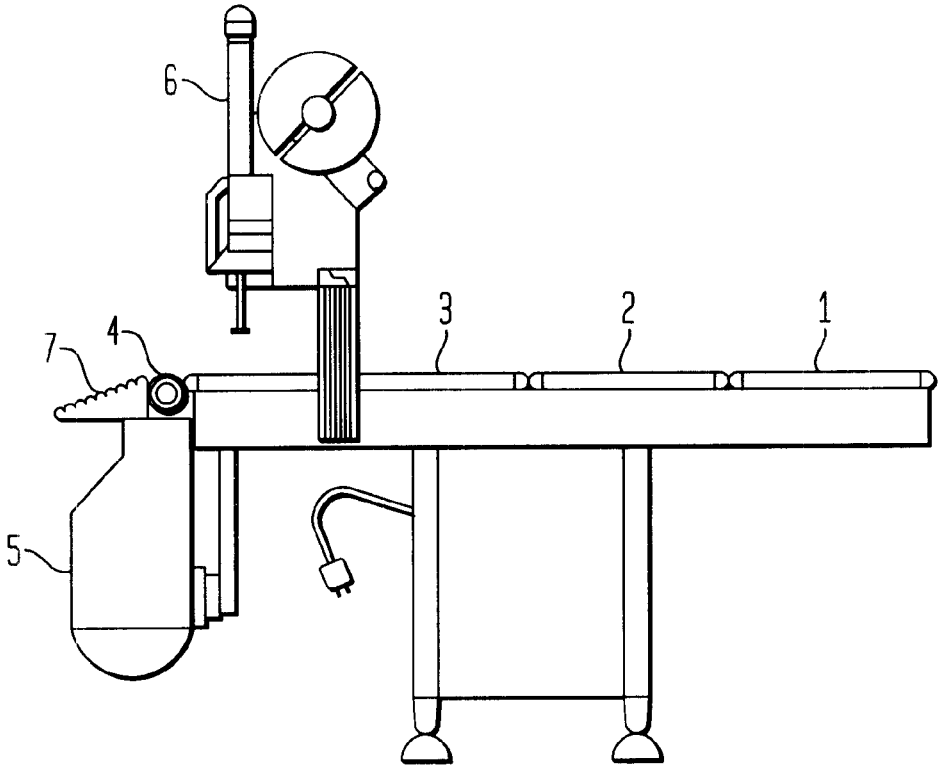
FIG. 1 shows a lateral overall view of an exemplary embodiment of a labeling device according to the invention.
Figure 2:
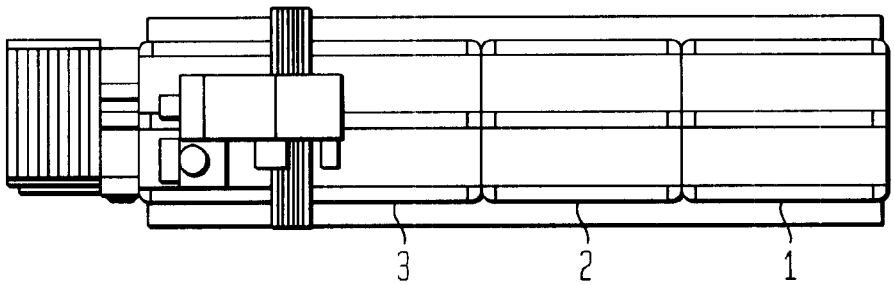
FIG. 2 shows a top view of the device according to FIG. 1.

FIG. 1 shows a device for labeling packages, in particular foodstuffs packages. The packages P (not shown in FIG. 1; see FIG. 3) are conveyed from right to left in FIG. 1 on the surface of a horizontal conveyance path. The horizontal path comprises three sections 1, 2, 3 with section 1 being a feed-in section, section 2 a weighing section and section 3 a section in which a printed label is applied to the package. For this latter purpose there is a first printing device 6, located at the top of the conveyance path by means of which a label can be applied to the top of the product, and a second printing device 5 acting on the underside of the package by means of which a label is applied to the underside of the package in a way yet to be described.

After application of the labels, the package travels on an exit section 7 which comprises a further roller 9 configured as a brush. This roller is driven at a speed of rotation that results in the circumferential speed of the further roller 9,exceeding the feed speed of the package leaving the labeling unit.

The printing device 6 functions in the conventional way, i.e. the printed label is applied to the top of the package by means of a movable cylinder.

Figure 3:
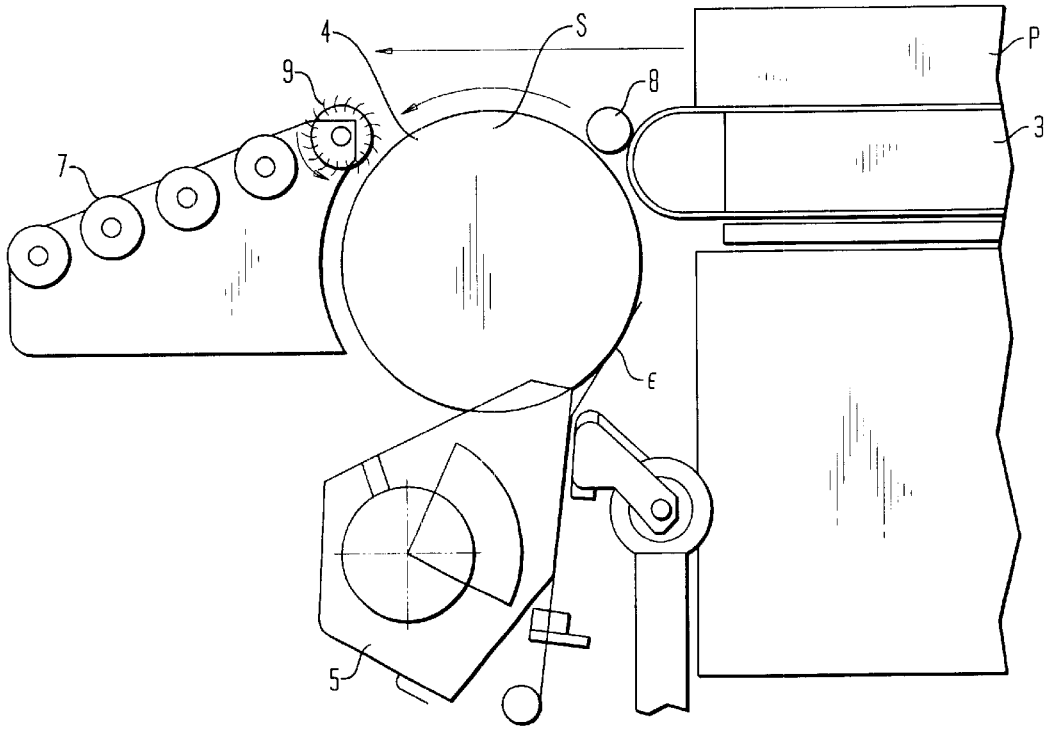
FIG. 3 shows a sectional view of the device according to FIG. 1 in the region of the labeling roller.

The function of the printing device for the label applied to the underside of the package is illustrated in more detail in FIG. 3 and is described below:

In the region of section 3, the packing P is conveyed by a conveyor belt in the directions of the arrow. At the end of the conveyance path 3 a labeling roller 4 acting as an application unit for printed labels is arranged, rotating in the direction of the arrow. The roller 4 is hollow, with a fan (not shown) being attached to one of its faces, for generating a partial vacuum in the interior of the roller. A printing device 5 is arranged on the underside of the labeling roller 4. A coupon roller (not shown) provides a label E, detachably affixed to a carrier strip, to said printing device 5. The printing device S, configured as a thermal printer, interacts with a removal device which removes the label from its carrier strip and with its coated side facing outward, moves it to the surface area of the labelling roller 4. From there it is conveyed in the direction of the arrow along the circumference of the surface area of the labeling roller 4 to the underside of the package P.

A support roller 8 is provided between the conveyance device 3 and the labeling roller 4. The package is guided along the top of said support roller 8 and the label E is conveyed in the gap between said support roller 8 and the labeling roller 4. On the exit side, a further roller 9 is provided between the labeling roller 4 and the exit section 7. While the support roller 8 prevents rotation or shifting of the package during the transition between the conveyance device 3 and the labeling roller, it is the purpose of the further roller 9 to additionally brush against the label that has previously been applied. This prevents the label from peeling off as a result of incomplete adhesion during the further conveyance of the package.

The labeling roller 4 is driven by a servo motor so as to be synchronous with the package feed-in so that the printed label, starting at the zenith S, is rolled onto the underside of the package P from its front to its rear, and pressed on by the weight of the package.

The embodiment described is suitable for small, right through to large packages, and for labeling the underside of these packages. The type of topology of the package underside is less important, with even curved or bent undersides able to be labeled. In addition, the labeling slot can be extended across the entire width of the transport system so that the label position across the direction of conveyance can be freely adjusted by moving the printer.

What is claimed is:

1. A device for labelling individual foodstuffs packages comprising:

a feed unit which transports a package to be labeled, wherein the feed unit comprises a horizontal conveyance path for the package comprising a feed-in-section, a continuous belt, a weighing section, an application section in which a printed label is applied to an underside of the package being transported along said conveyance path and an exit section; and a printing device which prints a label detachably affixed to a carrier strip;

wherein the application section comprises a roller which is driven so as to be synchronous with the package during the application process of the label, said roller being located adjacent to and below a terminal position of said belt, said roller receiving said package from said belt and conveying said package to said exit section of said conveyance path, wherein the printed label is removed from the carrier strip and carried by a part of an outer circumference of the roller and fed to the package, and wherein a point of labelling the package coincides with a zenith of the roller, and wherein said point of labelling is arranged on a horizontal projection in the direction the belt.

2. A device according to claim 1, wherein the printing device is arranged below the roller.

3. A device according to claim 1, wherein the printing device is a thermal print device.

4. A device according to claim 1, wherein a partial vacuum is applied to the roller.

5. A device according to claim 1, wherein the outer circumference of the roller comprises perforations or perforation patterns matched to the size of the label to be applied.

6. A device according to claim 1, wherein the surface of the roller, at least in part, comprises a silicon coating.

7. A device according to claim 1, wherein the printing device comprises a separation device which separates the label from the carrier strip.

8. A device according to claim 1, wherein between the feed unit and the roller, a support roller supporting the conveyance of the package is provided.

9. A device according to claim 8, wherein the support roller comprises a soft surface coating.

10. A device according to claim 1, wherein a further roller is arranged on an exit side behind the roller.

11. A device according to claim 10, wherein the further roller is driven at such a speed of rotation so that the circumferential speed of the further roller exceeds a feed speed of the package.

12. A device according to claim 10, wherein the further roller is configured as a brush.

* * * * *